United States Patent [19]

Kurita

[11] 4,257,601

[45] Mar. 24, 1981

[54] MANIPULATIVE GAME

[75] Inventor: Toshiaki Kurita, Tokyo, Japan

[73] Assignee: Tomy Kogyo Co., Inc., Tokyo, Japan

[21] Appl. No.: 11,216

[22] Filed: Feb. 12, 1979

[51] Int. Cl.[3] ..... A63B 7/00

[52] U.S. Cl. ..... 273/115; 273/1 R

[58] Field of Search ..... 273/1 R, 1 E, 1 M, 109, 273/113, 115–117, 108; 35/22 A

[56] References Cited

U.S. PATENT DOCUMENTS

| | | | |
|---|---|---|---|
| 2,524,548 | 10/1950 | Speirs | 273/115 UX |
| 3,643,946 | 2/1972 | Yunen | 273/109 X |
| 3,710,455 | 1/1973 | Liversidge et al. . | |
| 3,760,511 | 9/1973 | Matsumoto . | |
| 3,961,794 | 6/1976 | Goldfarb et al. . | |

*Primary Examiner*—Paul E. Shapiro

*Attorney, Agent, or Firm*—Edward O'Brian; K. H. Boswell

[57] ABSTRACT

A manipulative game can be constructed so as to utilize a housing having a transparent cover and a bottom member located within the housing adjacent to the cover and so as to be movable with respect to the cover between a no-play position in which one or more objects are clamped by the bottom member against the cover and a play position in which the objects may be moved to various locations relative to the bottom member. A timer is preferably employed with the game for operating an elevating structure which moves the bottom member between the play and the no-play positions. A stop mechanism is preferably provided for stopping the operation of the timer mechanism. Although the game is useable with only a single object within the space between the bottom member and the cover preferably a plurality of objects are used and the bottom member is provided with a series of recesses, each of the objects being capable of fitting within only one of the recesses.

13 Claims, 5 Drawing Figures

START
STOP 10
12
16
38
42
48
50
52
54
56
58
62
64
70
72
74
86
88
90
92
94
96
98
100
102
104
106
108
110
112
118
3
3

10
12
14
16
18
20
22
24
26
28
30
32
36
38
40
42
44
46
48
50
52
54
56
58
68
70
72
74
76
78
80
82
84
116
118

10
12
14
16
18
20
22
24
26
28
30
32
36
38
40
42
44
46
48
50
52
54
56
58
68
70
72
74
76
82
84
116
118

MANIPULATIVE GAME

BACKGROUND OF THE INVENTION

The invention set forth in this specification pertains to new and improved manipulative games and more particularly to manipulative games which employ a timer so as to indicate the end of a period of play.

It will, of course, be recognized that many types of manipulative games have been widely adopted and used. Many of such games have been constructed so as to utilize a transparent cover and a bottom member which is spaced from the cover so that one or more objects may be manipulated by moving the housing from one location to another. Such games are frequently utilized as puzzles or the like. Such games are considered to be highly desirable for many play purposes because all of the parts of such games are contained within a single housing. This prevents such parts from being lost or causing any sort of a physical hazard, such as, for example, might result from such parts reaching the mouth of a child.

Unfortunately manipulative games as indicated in the preceding do not include a timing means or structure marking or indicating the end of a play period by stopping further play until the timing means is again actuated. The desirability of utilizing a timing structure for cutting off or limiting the end of a play period with a game or toy is of course well established. A number of toys based upon well established psychological testing principles and employing a timer are well known. For example, games employing specially shaped blocks which are fitted within correspondingly shaped openings and which are then knocked from these openings at the end of a playing period are considered to be quite desirable. There are other related games which do not knock off such blocks out of openings but which employ shutter-type mechanisms in connection with such openings at the end of a time period or which drop playing pieces through openings at the end of a time period or which lock or latch playing pieces in various openings at the end of a playing period.

All of such prior games employing timing structures are considered to have significant merit. They are also considered to be disadvantageous in that they all utilize comparatively small playing pieces or blocks which are capable of becoming lost or which can be considered a type of hazard under certain circumstances as indicated in the preceding discussion. As a result of this it is considered that there is a need for new and improved manipulative games which effectively utilize a timing action so as to end or terminate play until a timer is actuated and which are constructed in such a manner as to preclude the playing pieces used from becoming lost or from creating any type of hazard.

SUMMARY OF THE INVENTION

A broad or basic object of the present invention is to provide new and improved manipulative games which will fill the need indicated in the preceding discussion. A further objective of the invention is to provide manipulative games of the type described which can be easily and conveniently constructed at a comparatively nominal cost and which are capable of prolonged use even when subjected to normal abuse by children. A further objective of the present invention is to provide games of the type indicated which can be constructed so as to utilize comparatively small sized playing pieces since there is no way that such playing pieces can be separated from the housing structures employed in such games during normal play. This is considered quite important in providing manipulative games which can be sold for use by comparatively small children.

In accordance with this invention these various objectives of the invention are achieved by providing a game having a housing constructed so as to include a transparent cover, a bottom member located beneath and adjacent to said cover, and at least one object located within the space between said cover and said bottom member, said object being capable of being moved within said space during the utilization of said game in which the improvement comprises: elevating means located within said housing and operatively associated with said bottom member for use in positioning said bottom member in either a play position in which said bottom member is spaced from said cover a sufficient distance so that said object can be moved within said space and a no-play position in which said object is clamped against movement between said cover and said bottom member, and timer means operatively associated with said elevating means for actuating said elevating means so as to move said bottom member from said play position to said no-play position after a time interval determined by the operation of said timer means.

BRIEF DESCRIPTION OF THE DRAWING

The invention is best more fully described with reference to the accompanying drawing in which.

Figures 1, 5:
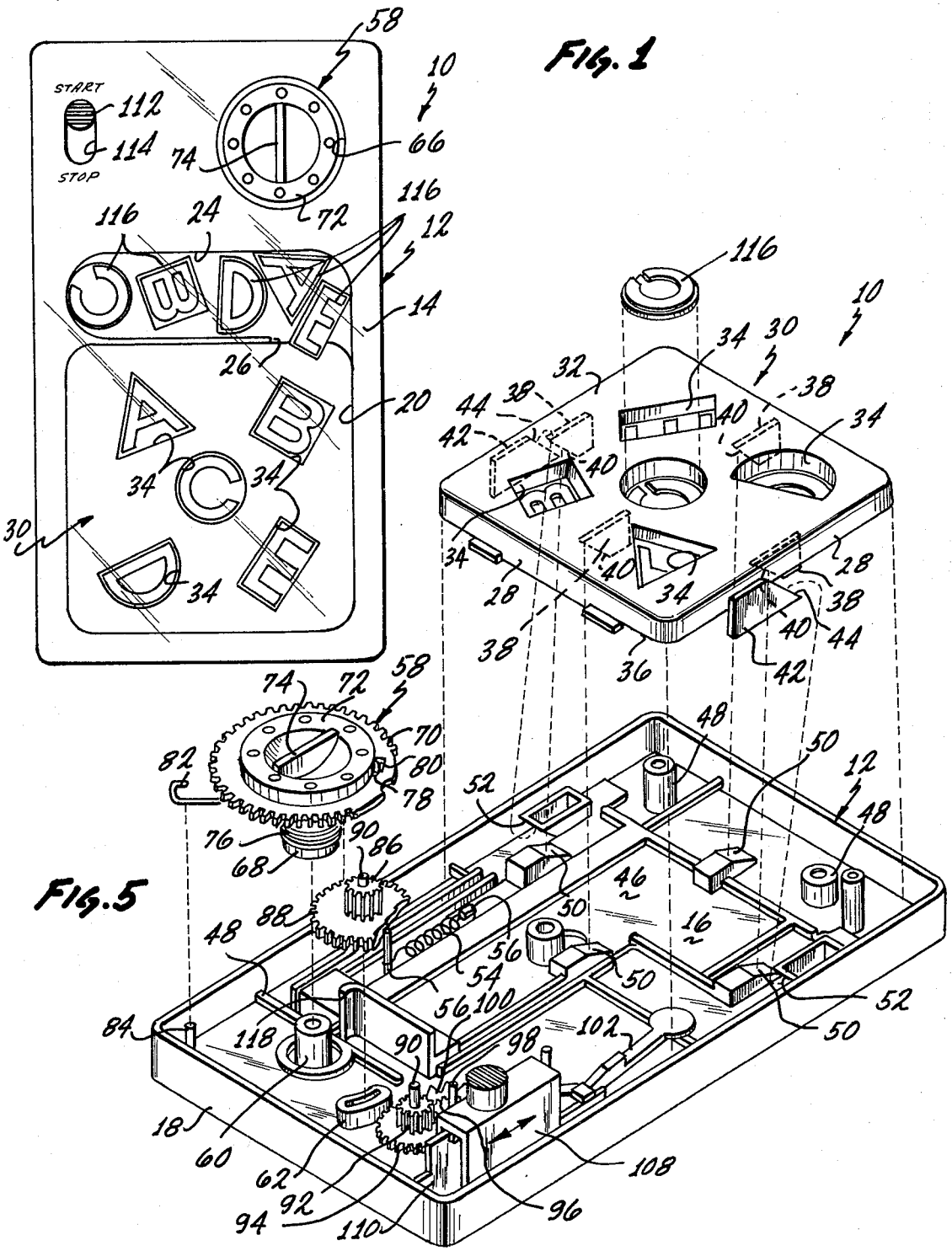
FIG. 1 is a top plan view of a presently preferred embodiment or form of a manipulative game in accordance with this invention.
FIG. 5 is a rear isometric, partially exploded view taken of the parts of the game shown in FIG. 2.
Figure 2:
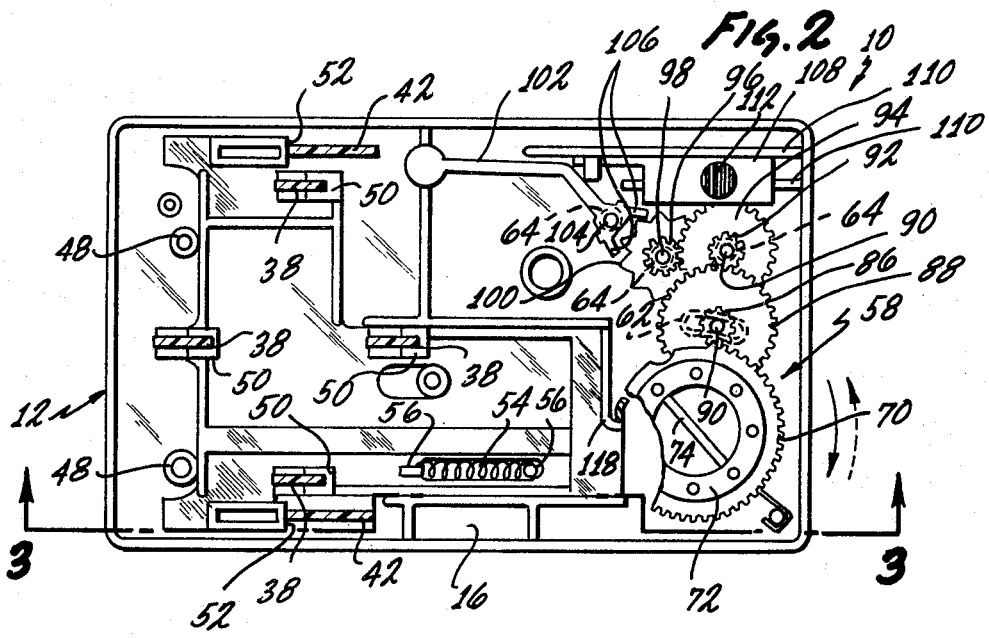
FIG. 2 is a top plan view of this game with the cover of the housing used with this game and with an internal dividing wall removed.

The manipulative game illustrated in the drawing is constructed so as to utilize the operative principles or features of the invention set forth and defined in the appended claims forming a part of this disclosure. These concepts or principles are of such a nature that they can be easily incorporated within other differently appearing and differently constructed games through the use or exercise of routine design and engineering skill in the field of mechanical toys and games.

DETAILED DESCRIPTION

In the drawings there is shown a manipulative game 10 in accordance with this invention which includes a generally rectilinear housing 12 including a transparent cover 14 positioned upon an opaque bottom 16 so as to enclose an internal dividing wall 18 and various other operative parts as hereinafter described. This dividing wall 18 fits closely against the cover 14. It is provided with an enlarged generally square opening 20 having parallel walls 22. This dividing wall 18 is also providing with an elongated, enlarged cavity 24 serving to define a pocket (not separately numbered) between the wall 18 and the cover 14. Preferably this wall 18 includes a gap or notch 26 leading adjacent to the cover 14 from the cavity 24 to the opening 20.

Figure 3:
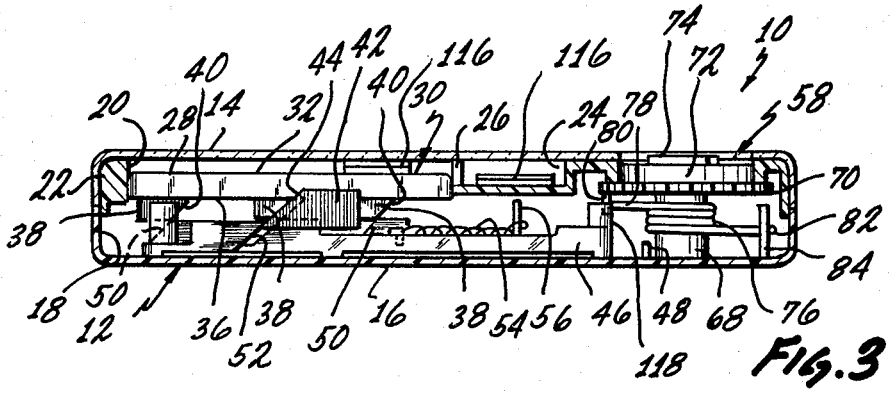
FIG. 3 is a cross-sectional view taken at line 3—3 of FIG. 1 with a bottom member within the housing in a no-play position.
Figure 4:
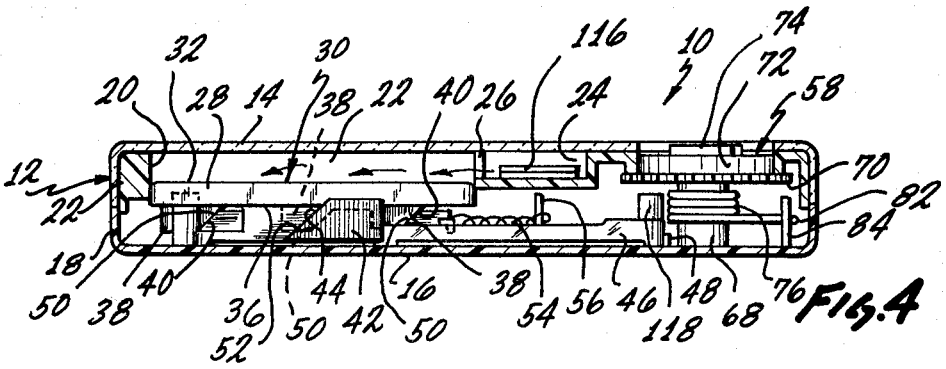
FIG. 4 is a cross-sectional view similar to FIG. 3 showing the bottom member in a play position.

The walls 22 of the opening 20 serve as bearings so as to guide sides 28 of a generally square appearing bottom member 30 in such a manner that this bottom member 30 can be moved between no-play and play positions as shown in FIGS. 3 and 4, respectively. This bottom member 30 includes a top surface 32 which is provided with a plurality of individual pockets or recesses 34. These recesses 34 are preferably shaped differently from one another. The bottom surface 36 of the bottom member 30 carries four downwardly extending, generally vertical walls 38, each of which is provided with a sloping edge 40. This bottom surface 36 also carries two other downwardly extending walls 42 which are also provided with sloping edges 44.

Within the interior of the housing 12 generally beneath the bottom member 30 there is located a plate 46 extending generally parallel to the bottom member 30. This plate 46 rests upon the bottom 16 between various limiting projections 48 on the bottom 16 which serve to permit movement of the plate 46 between positions corresponding to the no play and play positions of the bottom member 30 as indicated in FIGS. 3 and 4 respectively. This plate 46 carries four upstanding sloping surfaces or ramps 50 which are located generally adjacent to the walls 38.

During movement of the plate 46 from the play position noted to the no play position the edges 40 will be engaged by the surfaces 50 so as to move the bottom member 30 to the no play position indicated in FIG. 3 After such movement the edges 44 of the walls 42 will be engaged by other sloping surfaces or ramps 52 on the plate 46 in such a manner as to limit the amount that the bottom member 30 may be moved upwardly generally away from the bottom 16. This plate 46 is normally biased in the play position through the use of a small coil spring 54 extending between projections 56 on the plate 46 and on the bottom 16.

The position of this plate 46 and the bottom member 30 are normally controlled during the use of the game 10 through the use of what may be termed a timer mechanism or timer means 58. This timer means 58 includes an upstanding cylindrical boss 60 serving as a bearing located on the bottom 16. The timer means 58 also includes two aligned bosses 62 of a generally arcuate nature, one of which is located on the bottom 16 and the other of which is located on the dividing wall 18. Three pairs (not separately numbered) of aligned cylindrical bosses 64 are also provided on the bottom 16 and the dividing wall 18. The timing means 58 also includes aligned openings 66 in both the dividing wall 18 and in the cover 16.

These openings 66 cooperate with the boss 60 in serving as a bearing (not separately numbered) for a principal part (not separately numbered) of the timing means 58 consisting of a bottom cylinder 68 attached to an enlarged flange-like partial spur gear 70 which in turn is attached to a centrally located flat cylinder 72. This cylinder 72 fits within the openings 66 with the gear 70 against the dividing wall 18 so that a handle 74 carried by this cylinder 72 can be manipulated during the use of the game 10. During manipulation the cylinder 72 is turned in such a manner that a small coil spring 76 located around the cylinder 72 is tightened or "wound" as the result of one of the ends 78 of the spring 76 being secured to an opening 80 in the gear 70 and as a result of another of its ends 82 being engaged with a pin 84 on the bottom 16.

As the handle 74 is turned so as to wind the spring 76 the motion of the spur gear 70 will be transmitted to a small pinion gear 86 formed adjacent to a spur gear 88. The pinion 86 and the spur gear 88 are attached to a common shaft 90 located in the arcuate bosses 62 so as to be loosely clamped between them. As the winding motion is transmitted to the pinion 86 this will tend to cause the shaft 90 to slide within the bosses 62. This has the effect of withdrawing the spur gear 88 from another pinion 92 as the handle 74 is being manipulated.

When the spring 76 is wound and the handle 74 will be released the spring 76 will tend to unwind. Because of the contact between the pinion 86 and the spur gear 70 as this occurs the shaft 90 will again slide in the bosses 64 so as to bring the spur gear 88 in contact with the pinion 92. The force of the spring 76 will thus be transmitted through the pinion 86 and the spur gear 88 to another pinion 92. This pinion 92 is attached to another spur gear 94 and both are carried by another shaft 90 carried by bosses 64.

The force applied to the pinion 92 is transmitted by the gear 94 to a third pinion gear 96 located on a shaft 98 carried by two of the bosses 64. Such force will be transmitted by the pinion 96 to an attached escapement wheel 100 so as to tend to cause rotation of this escapement wheel 100. Such motion will be controlled through the use of a pendulum-type escapement lever or arm 102 carried by a shaft 104 located in two other of the bosses 64. This arm 102 carries the usual pallets 106 which cooperate with the escapement wheel 100 in the usual manner. The escapement mechanism used here is closely related to a conventional dead-beat escapement.

In the game 10 the unwinding of the spring 76 may be stopped through the utilization of a sliding stop level 108 located between walls 110 on the bottom 16. This stop level 108 includes a projection 112 which extends upwardly through aligned openings 114 in the dividing wall 18 and in the cover 14 so that the level 108 may be manipulated between a position in which it prevents movement of the arm 102 by engaging this arm 102 so as to stop the unwinding of the spring 76 is permitted.

The game 10 also includes a number of small objects 116. These objects 116 are dimensioned so that all of them can freely slide within the cavity 24. They preferably also all are dimensioned so that each of the objects 116 is capable of fitting within a single one of the recesses 34. These objects 116 are relatively flat and are of such dimension that when the bottom member 30 is in the no play position indicated in the preceding they will be clamped against movement between the bottom member 30 and the cover 14 unless they are in an appropriate recess 34. These objects 116 are also preferably dimensioned so they will not normally come out of the recesses 34 when the bottom member 30 is in the no play position.

With the described structure it is theoretically possible for an object 116 to be trapped between the bottom member 30 and the cover 14 so as to space the bottom member 30 from the cover 14 a sufficent distance so that a particular object 116 located within a recess 34 can be removed from the recess 34 to the space between the cover 14 and the bottom member 30 by turning the housing 12 upside down. The fact that this theoretically can occur is considered unimportant to the operation of the game 10 since the likelihood of it occurring is quite limited during the normal use of the game 10.

Normally as the game 10 is to be used after having previously been used the bottom member 30 will be in a no play position as indicated in the preceding discussion and the various objects 116 will be either in the recesses 34 or will be clamped against the cover 14 by the bottom member 30. At this time a projection 118 on the spur gear 70 serving more or less as a cam will be located against the plate 46 so as to bias this plate 46 against the pressure of the spring 54 in such a manner that the edges 40 are engaged by the surfaces 50 so as to bias the bottom member 30 upwardly into the no play position indicated.

As the game is to be used preferably the stop level 108 is first moved to a position into engagement with the arm 102. Then the handle 74 is rotated so as to wind the spring 76. As this occurs the projection 118 will be moved out of engagement with the plate 46. The spring 54 will then move this plate 46 so as to disengage the edges 40 and the surfaces 50. This will permit the bottom member 30 to fall downwardly to the play position noted by the action of gravity. As this occurs the edges 44 will fit against the surfaces 52 so as to prevent the bottom member 30 from moving toward the cover 14 as the housing 12 is turned more or less upside down in order to remove objects 116 from the recesses 34.

After such removal the housing 12 can be manipulated so as to place all of the objects 116 in the cavity 24. Then the stop level 108 can be manipulated so as to disengage the arm 102 so as to commence timing of an interval during which the housing 12 may be manipulated in order to place the objects 116 in the recesses 34. The moment such disengagement of the arm 102 occurs the spring 76 will start to "wind down" for a time interval which is dependent upon the amount that the handle 74 has been initially rotated. At the end of the time interval the spring 76 will rotate the spur gear 70 to a sufficient extent so as to cause the projection 118 to engage the plate 46. During such engagement the projection 118 moves against the plate 46 with sufficient force to move the plate 46 against the spring 54 to a position in which the surfaces 50 engage the edges 40 so as to move the bottom member 30 to the no play position indicated in the preceding.

I claim:

1. A game having a housing constructed so as to include a transparent cover, a bottom member located beneath and adjacent to said cover, and at least one object located within the space between said cover and said bottom member, said object being capable of being moved within said space during the utilization of said game in which the improvement comprises:

said bottom member including a top surface adjacent to said cover and at least one recess in said top surface, said recess being dimensionied so as to be capable of containing said object, elevating means located within said housing and operatively associated with said bottom member for use in positioning said bottom member in either a play position in which said bottom member is spaced from said cover a sufficient distance so that said object can be moved within said space and within said recess and a no-play position in which said object is clamped against movement between said cover and said bottom member or is located within said recess, and timer means operatively associated with said elevating means for actuating said elevating means so as to move said bottom member from said play position to said no-play position after a time interval determined by the operation of said timer means, said housing including a pocket adjacent to said cover and said space between said cover and said bottom member, said pocket being sufficiently large so as to receive and hold at least said object, said bottom member in said no-play position serving to block the movement of said object from said pocket into said space between said cover and said bottom member.

2. A game as claimed in claim 1 wherein:

said timer means is capable of being actuated so that thereafter it is capable of determining said time interval, and said timer means is operatively associated with said elevating means so that as said timer means is actuated so that it is thereafter capable of determining said interval, the actuation of said timer means causes movement of said bottom member from said no-play position to said play position.

3. A game as claimed in claim 2 including:

stop means for preventing the operation of said timer means so as to prevent said timer means from determining said interval.

4. A game as claimed in claim 1 wherein: there are a plurality of said objects, and there are a plurality of said recesses, each of said recesses being capable of containing one of said objects.

5. A game as claimed in claim 4 wherein: each of said objects is capable of fitting within a single one of said recess.

6. A game having a housing constructed so as to include a transparent cover, a bottom member located beneath and adjacent to said cover, and at least one object located within the space between said cover and said bottom member, said object being capable of being moved within said space during the utilization of said game in which the improvement comprises:

elevating means located within said housing and operatively associated with said bottom member for use in positioning said bottom member in either a play position in which said bottom member is spaced from said cover a sufficient distance so that said object can be moved within said space and a no-play position in which said object is clamped against movement between said cover and said bottom member, timer means operatively associated with said elevating means for actuating said elevated means so as to move said bottom member from said play position to said no-play position after a time interval determined by the operation of said timer means, said housing including a pocket adjacent to said cover and said space between said cover and said bottom member, said pocket being sufficiently large so as to receive and hold at least said object, said bottom member in said no-play position serving to block the movement of said object from said pocket into said space between said cover and said bottom member.

7. A game as claimed in claim 6 wherein:

there are a plurality of said objects, and said bottom member includes a recess corresponding to each of said objects, each of said objects being capable of fitting within only one of said recesses.

8. A game as claimed in claim 6 wherein:

said timer means is capable of being actuated so that thereafter it is capable of determining said time interval, and said timer means is operatively associated with said elevating means so that as said timer means is actuated so that it is thereafter capable of determining said interval, the actuation of said timer means causing movement of said bottom member from said no-play position to said play position, and including stop means for preventing the operation of said timer means so as to prevent said timer means from determining said interval.

9. A game having a housing constructed so as to include a transparent cover, a bottom member located beneath and adjacent to said cover, and at least one object located within the space between said cover and said bottom member, said object being capable of being moved within said space during the utilization of said game in which the improvement comprises:

elevating means located within said housing and operatively associated with said bottom member for use in positioning said bottom member in either a play position in which said bottom member is spaced from said cover a sufficient distance so that said object can be moved within said space and a no-play position in which said object is clamped against movement between said cover and said bottom member, and said bottom member is mounted within said housing so as to be capable of movement toward and away from said cover between said play and said no-play positions, said elevating means includes a plate located within said housing generally parallel to said bottom member on the side thereof remote from said cover, and cooperating sloping surfaces on said bottom member and on said plate for engaging one another during movement of said plate so as to determine the position of said bottom member within said housing, said plate being movably mounted within said housing so as to be capable of being moved relative to said bottom member, timer means operatively associated with said elevating means for actuating said elevating means so as to move said bottom member from said play position to said no-play position after a time interval determined by the operation of said timer means, said timer means includes cam means engaging a portion of said plate serving as a cam follower so as to move said plate in order to cause said sloping surfaces on said plate and said bottom member to move with respect to one another so as to position said bottom member in said play position each time said timer means is actuated so as to be capable of releasing said portion of said plate so as to cause relative movement between said sloping surfaces so as to position said bottom member in said no-play position at the end of said interval, said elevating means also including spring means connecting said housing to said plate for moving said plate when said portion of said plate is disengaged by said cam means, said housing including pocket adjacent to said cover and said space between said cover and said bottom member, said pocket being sufficiently large so as to receive and hold at least said object, said bottom member in said no-play position serving to block the movement of said object from said pocket into said space between said cover and said bottom member.

10. A game as claimed in claim 9 wherein:

said timer also includes a spring capable of being deformed as said timer is actuated so as to be capable of determining said intervals, and clockwork means including escapement means operated by said spring for use in determining said intervals, said game also including stop means for stopping the operation of said timer means by engaging a part of said timer means, said stop means being mounted on said housing.

11. A game as claimed in claim 10 wherein:

said stop means comprises a member capable of being moved so as to engage the escapement level of said escapement means.

12. A game as claimed in claim 11 wherein:

is sufficiently large so as to receive and hold a plurality of said objects, said game includes a plurality of said objects, said bottom member includes a recess located therein corresponding to each of said objects, each of said objects being capable of fitting within only one of said recesses.

13. A game as claimed in claim 9 wherein:

is sufficiently large so as to receive and hold a plurality of said objects, said game includes a plurality of said objects, said bottom member includes a recess located therein corresponding to each of said objects, each of said objects being capable of fitting within only one of said recesses.

* * * * *

UNITED STATES PATENT AND TRADEMARK OFFICE

CERTIFICATE OF CORRECTION

PATENT NO. : 4,257,601
DATED : March 24, 1981
INVENTOR(S) : Toshiaki Kurita

It is certified that error appears in the above-identified patent and that said Letters Patent are hereby corrected as shown below:

The word "level" should be the word --lever-- in each of the following locations:

Column 4, line 36
Column 4, line 38
Column 4, line 40
Column 5, line 13
Column 5, line 28
Column 8, line 33

The words --said pocket-- should be inserted at the start of line 2 in both claims 12 and 13 of the patent.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*